United States Patent [19]

Malaker

[11] Patent Number: 4,877,434

[45] Date of Patent: Oct. 31, 1989

[54] CRYOGENIC REFRIGERATOR

[75] Inventor: Stephen F. Malaker, Mountainside, N.J.

[73] Assignee: Cryodynamics, Inc., Mountainside, N.J.

[21] Appl. No.: 60,034

[22] Filed: Jun. 9, 1987

[51] Int. Cl.[4] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,521,461 | 7/1970 | Granryd | 62/6 |
| 3,698,182 | 10/1972 | Knoos | 62/6 |
| 4,282,716 | 8/1981 | Momose et al. | 62/6 |
| 4,498,296 | 2/1985 | Dijkstra et al. | 60/520 |
| 4,543,793 | 10/1985 | Chellis et al. | 62/520 |

*Primary Examiner*—Ronald C. Capossela

*Attorney, Agent, or Firm*—Kevin McMahon

[57] ABSTRACT

A modified Stirling cycle cryogenic refrigerator having a cold head, compressor and expander cylinders connected by a channel, and a compressor piston and an expander piston reciprocally mounted in the respective cylinders. A thin-walled hollow, evacuated, cylinderical metal extender is mounted on the side of the expander piston close to the cold head for shielding the expander from the low temperatures of the working gas in the vicinity of the cold head.

11 Claims, 2 Drawing Sheets

CRYOGENIC REFRIGERATOR

FIELD OF INVENTION

This invention relates generally to modified Stirling cycle cryogenic refrigerators and more particularly to modified Stirling cycle refrigerators having an improved expander piston dome.

BACKGROUND

Modified Stirling cycle refrigerators, such as those of the type described in U.S. Pat. No. 3,074,244 have proved to be the most reliable, most efficient and lowest cost cryogenic refrigerators available. They have the additional important advantages of operating using non-hazardous working gases such as helium or nitrogen and of not requiring any condenser or evaporator coils. Cryogenic refrigerators of the type described in the above patent regularly achieve temperatures below 100° K. at the cold head and have been operated at temperatures below 30° K. at the cold head.

Such refrigerators, depending on capacity, include one or more sets of compressor and expander pistons. Each expander piston is generally protected from the extreme cold temperatures of the working gas in the vicinity of the cold head by an extender portion, sometimes referred to as the expander dome, mounted on the face of the expander piston toward the cold head. The extender is normally made of a thermally insulating material such as wood or plastic which is able to withstand extremely cold temperatures and has a cross-sectional diameter slightly smaller than that of the expander piston. The length of the extender is chosen to be long enough to provide adequate thermal isolation to the expander piston and so that the volume of the expander cylinder is appropriate for operation of the system.

Although the cryogenic refrigerators in accordance with the invention operate very well in most applications, in larger capacity refrigerators the reciprocating mass of the extender becomes large, which tends to reduce the efficiency and reliability of the unit. In addition, if the extender is at all porous it may absorb some of the refrigerant which reduces the compression of the refrigerant and may adversely affect the properties of the extender.

SUMMARY OF INVENTION

In accordance with the invention there is provided a modified Stirling cycle cryogenic refrigerator having a first compressor piston for compressing a working gas in a compression cylinder, a second expander piston for expanding the working gas in a second cylinder, and a cold head in thermal contact with the working gas in said expander cylinder, and which includes a thin-walled, hollow, evacuated extender affixed to the expander piston on the side proximate the cold head for thermally isolating the expander piston from the working gas in the second cylinder.

These and other advantages and features of the invention will become more fully apparent from the following detailed description of the preferred embodiment of the invention as illustrated in the accompanying drawings.

DESCRIPTION OF PREFERRED EMBODIMENT

Figure 1:
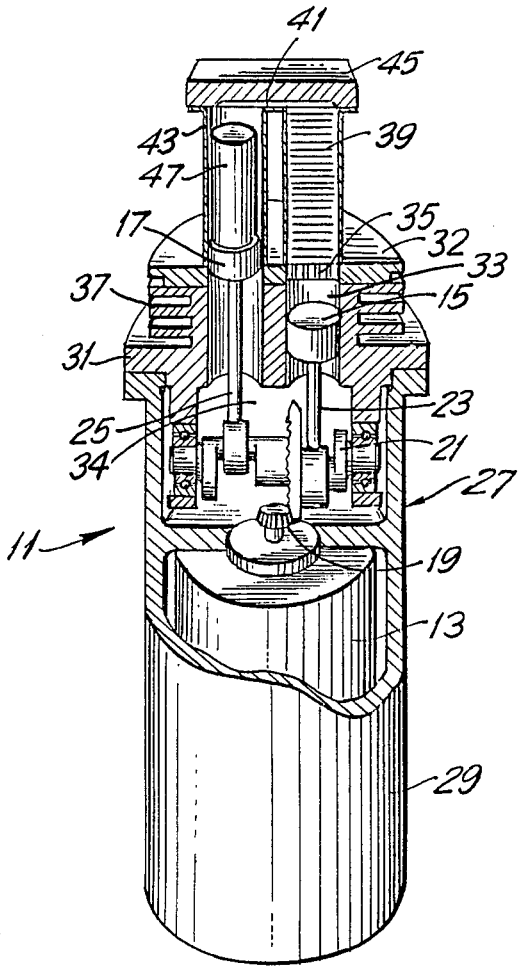
FIG. 1 is a cutaway isometric view of a modified Stirling cycle cryogenic refrigerator in accordance with the invention.

The cryogenic refrigerator of the present invention constitutes an improvement in the closed cycle modified Stirling cycle refrigerator described in the U.S. Pat. No. 3,074,244 and operates in the same basic manner as is described in that patent. Referring to the preferred embodiment of the invention illustrated in FIG. 1 of the drawings, the cryogenic refrigerator 11 is driven by an electrical motor 13 which drives the compressor piston 15 and the expander piston 17 through a bevel gear coupling 19, a drive shaft 21 and the compressor and expander piston rods 23 and 25, respectively. The refrigerator 11 is encased in an hermetically sealed case 27 made up of a lower case portion 29, cylinder block 31 and a cylinder head 32. The interior 34 of the refrigerator 11 is filled with a working gas which is preferably helium but can be other gases such as nitrogen.

As is more completely described in the above referred to U.S. Pat. No. 3,074,244, the working gas is isothermally compressed in the compression cylinder 33 by the compressor piston 15 with the heat of compression being dissipated through the heat exchanger 35 and the cooling fins 37. The compressed working gas is then transferred at a constant volume through the regenerator 39 and the channel 41 to the expander cylinder 43 where it is isothermally expanded by the expander piston 17. During the expansion heat is extracted from the cold head 45. The gas is then transferred at constant volume back through the channel 41, regenerator 39 and the heat exchange 35 to the compressor cylinder 33 where the cycle begins again.

The cold head 45 is progressively cooled on each cycle until it reaches cryogenic temperatures. The expander piston 17 is protected from exposure to the extremely cold working gas in the expander cylinder 43 by the extender 47.

Figure 2:
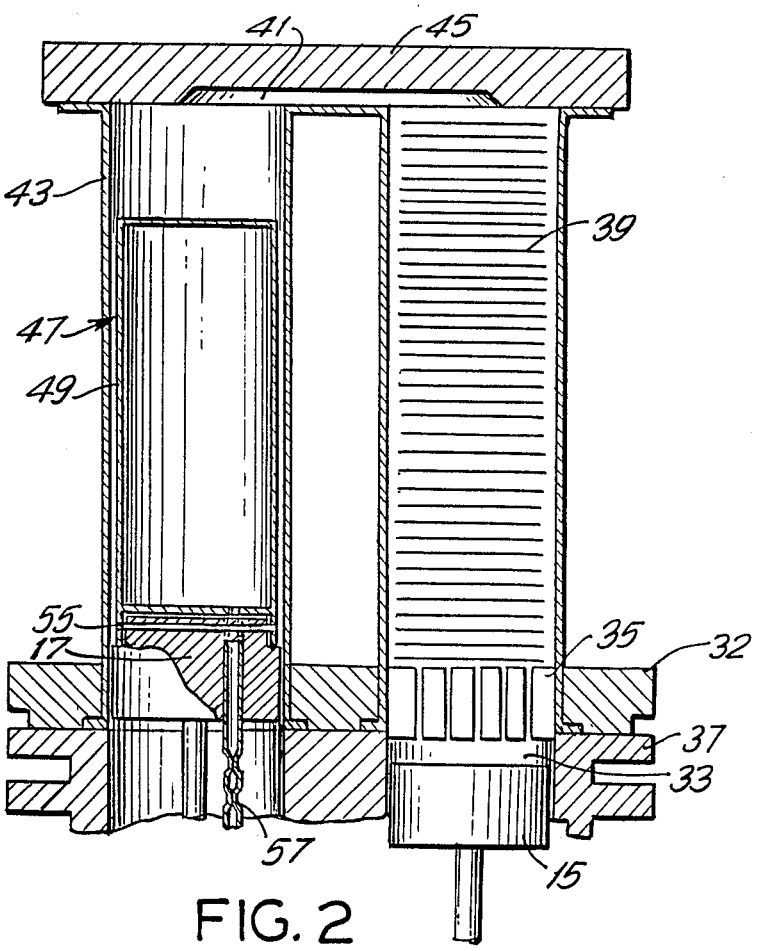
FIG. 2 is a sectional view of a portion of the cryogenic refrigerator in accordance with the invention.
Figure 3:
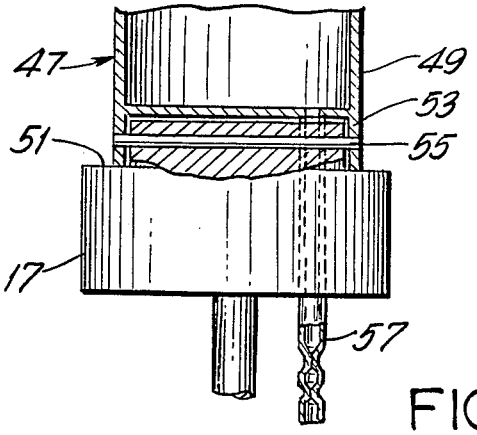
FIG. 3 is a sectional view of the mounting of the extender on the expander piston in accordance with the invention.

Referring to FIGS. 2 and 3 of the drawings, in accordance with the invention the extender 47 is formed of a thin-walled metal cylinder 49 which is fixedly mounted on the face of the expander piston 17 proximate the cold head 45. A neck and shoulder 51 is formed in the upper portion of the expander piston 17. A skirt 53, which extends from the bottom of the cylinder 49, fits snugly over the neck 51. The cylinder 49 is affixed to the expander pistion 17 by means of a pin 55 that passes through the skirt 53 and the neck 51. The dimensions of the neck and shoulder and the spaces between the piston 17 and the cylinder 49 are exaggerated somewhat in the drawings for illustrative purposes.

A thin exhaust tube 57 extends from the bottom of cylinder 49 through the expander pistion 17. After the cylinder 49 is mounted on the expander pistion 17, the air therein is exhausted through the tube 57 by means of a vaccuum pump. The tube 57 is then permanently sealed by crimping the end thereof that extends through the piston 17 with a crimping tool in a well known manner. The tube 57 is preferably quite thin for ease of crimping and may be about 0.015 inch in diameter.

The cylinder 49 is preferably formed of stainless steel. It has a circular cross section and its external diameter is slightly smaller than that of the expander piston 17 so that it moves freely in the expander cylinder 43 without binding on the cylinder walls. The main purpose of the cylinder 49 is to thermally isolate the expander piston 17 from the extreme cold of the working gas in the expander cylinder 43. Depending on the gas used and the application, the temperature of the working gas can get as low as 18° K. The annulus between the exterior of the metal extender cylinder and the expander cylinder wall should by quite thin, on the order of 0.008 to 0.013 inches. The length of the expander should be long enough so that heat transfer between the top of the cylinder 49 and expander piston 17 is minimized but not so long that the dead volume of the annulus between the extender 47 and the walls of the expander cylinder 43 adversely affects the compression ratio of the working gas. Generally the length of the extender 47 should be between about 2 to 6 inches depending on the capacity of the refrigerator.

Since the extender cylinder 49 is evacuated, there is essentially no heat transfer by conduction or convection through its interior portion. The only significant heat transfer path is along the length of the thin walls of the cylinder 49. Since the cross sectional area of the walls is quite small, and the length of the path is relatively long, there is only a small amount of heat transfer along its length and the extender 47 provides excellent thermal isolation for the expander piston 17.

The use of thin walled, evacuated metal cylinder 49 as the extender 47 has significant advantages over the previously used wood or plastic extenders, particularly for large capacity refrigerators. The reciprocating mass of the cylinder 49 in accordance with the invention is much lower than that of the solid wood or plastic extenders used previously so that the refrigerator is more reliable and has longer life than previous units. The stainless steel of the cylinder 49 is non-porous and so doesn't absorb any of the working gas as prior wood or plastic extenders could. Such absorbtion could adversely effect the thermal performance of the extender and reduce the compression of the working gas. Additionally the thermal performance of the extender 47 in accordance with the invention is better at extremely low temperatures than the prior wood or plastic extenders as a result of its non-permeability and shrinkage characteristics.

The walls of the cylinder 49 should be as thin as possible while still being thick enough to withstand the pressure differential between the evacuated interior and the compressed working gas transferred from the compressor cylinder 33 to the expander cylinder 43. In addition the cylinder 49 must be able to withstand the thermal and mechanical stresses in vibration of the refrigerator (at about 20 Hz) and of the application in which the refrigerator is used. For a cylinder 49 made of stainless steel the thickness of the walls may be between about 0.010 and 0.015 inches depending on the application.

I claim:

1. A modified Stirling cycle cryogenic refrigerator having first piston for compressing a working gas in a first cylinder, a second piston for expanding such working gas in a second cylinder, channel means connecting said first and second cylinders, and a cold head in thermal contact with said working gas in said second cylinder, comprising:

a thin walled, hollow, evacuated extender affixed to said second piston on the face proximate said cold head for thermally isolating said second piston from the working gas in said second cylinder.

2. The modified Stirling cycle cryogenic refrigerator of claim 1 wherein said extender includes a thin-walled sealed metal cylinder affixed to said second piston, said metal cylinder having an exterior diameter slightly smaller than said second piston for free movement in said second cylinder.

3. The modified Stirling cycle refrigerator of claim 2 whereon said thin walled metal cylinder is formed of stainless steel.

4. The modified Stirling cycle refrigerator of claim 3 wherein the walls of said thin-walled metal cylinder are between about 0.010 and 0.015 inches thick.

5. The modified Stirling cycle refrigerator of claim 2 wherein said second piston includes a neck portion and said metal cylinder includes a skirt which fits snugly over said neck portion and further including means for fixedly mounting said metal cylinder to said second piston.

6. The modified Stirling cycle refrigerator of claim 2 further including a thin exhaust tube extending through said second piston for use in exhausing the air from inside said cylinder; the end of said tube being sealed after said air is exhausted.

7. The modified Stirling cycle refrigerator of claim 1 wherein the thickness of the annulus between the thin-walled cylinder and said second cylinder is between 0.008 and 0.013 inches.

8. The modified Stirling cycle refrigerator of claim 1 wherein said thin-walled cylinder is between two and six inches long.

9. The modified Stirling cycle refrigerator of claim 6 wherein said means for fixedly mounting said metal cylinder to said pin includes a pin extending through said skirt and said neck portion.

10. A modified Stirling cycle cryogenic refrigerator having a cold head, a compressor piston for compressing a working gas in a compressor cylinder, an expander piston for expanding the compressed gas at a location in thermal contact with the cold head and channel means including a regenerator interconnecting said compressor cylinder and said location, comprising:

a thin-walled hollow metal cylinder mounted on the side of said expander piston proximate said cold head for shielding said expander piston from the low temperatures of said working gas in the vicinity of said cold head, the air from within said metal cylinder having been exhausted and said metal cylinder being sealed.

11. The modified Stirling cycle refrigerator of claim 10 wherein said location includes an expansion cylinder in which said expander pistion reciprocates and wherein said metal cylinder has an exterior diameter slightly smaller than the internal wall of said expander cylinder for free movement of said metal cylinder in said expander cylinder.

* * * * *